US007672630B2

(12) United States Patent
Hachisuka

(10) Patent No.: US 7,672,630 B2
(45) Date of Patent: Mar. 2, 2010

(54) IMAGE FORMING APPARATUS AND IMAGE FORMING METHOD WITH IMPROVED CLEANING MECHANISM

(75) Inventor: Toshiharu Hachisuka, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 750 days.

(21) Appl. No.: 11/436,596

(22) Filed: May 19, 2006

(65) Prior Publication Data

US 2006/0263122 A1 Nov. 23, 2006

(30) Foreign Application Priority Data

May 20, 2005 (JP) ..... 2005-148443

(51) Int. Cl.
*G03G 15/20* (2006.01)

(52) U.S. Cl. ..... 399/327

(58) Field of Classification Search ..... 399/327, 399/353, 357

See application file for complete search history.

(56) References Cited

U.S. PATENT DOCUMENTS

| | | | | |
|---|---|---|---|---|
| 4,899,197 | A * | 2/1990 | Davis et al. | |
| 6,405,002 | B2 | 6/2002 | Ogiyama | |
| 6,577,840 | B2 | 6/2003 | Hachisuka | |
| 6,865,363 | B2 | 3/2005 | Hachisuka | |
| 2005/0047830 | A1 * | 3/2005 | Tango et al. | 399/353 |
| 2005/0163543 | A1 | 7/2005 | Satoh | |
| 2007/0116499 | A1 * | 5/2007 | Derimiggio et al. | 399/327 |

FOREIGN PATENT DOCUMENTS

| | | | |
|---|---|---|---|
| JP | 58017469 | A * | 2/1983 |
| JP | 02143283 | A * | 6/1990 |
| JP | 05-224555 | | 9/1993 |
| JP | 10-312130 | | 11/1998 |
| JP | 11-184298 | | 7/1999 |
| JP | 11352816 | A * | 12/1999 |

* cited by examiner

*Primary Examiner*—David M Gray
*Assistant Examiner*—Laura K Roth
(74) *Attorney, Agent, or Firm*—Harness, Dickey & Pierce, P.L.C.

(57) ABSTRACT

An image forming apparatus includes an image forming mechanism to form a toner image on a recording medium according to image data and a fixing mechanism to fix the toner image on the recording medium. The fixing mechanism includes a fixing member configured to apply heat to the toner image on the recording medium and a cleaning mechanism to clean a surface of the fixing member. The cleaning mechanism includes a cleaning member and a controller. The cleaning member removes contaminants from the surface of the fixing member. The controller controls the cleaning member to cause friction with the fixing member for a time period when a job starts to remove the contaminants from the surface of the fixing member and controls the cleaning member so as not to cause friction with the fixing member after the time period elapses.

16 Claims, 8 Drawing Sheets

IMAGE FORMING APPARATUS AND IMAGE FORMING METHOD WITH IMPROVED CLEANING MECHANISM

CROSS-REFERENCE TO RELATED APPLICATION

The present application is based on and claims priority to Japanese patent application No. 2005-148443 filed on May 20, 2005 in the Japan Patent Office, the entire contents of which are hereby incorporated herein by reference.

BACKGROUND

1. Field

Example embodiments of the present invention generally relate to an image forming apparatus and/or an image forming method with an improved cleaning mechanism, such as one for removing contaminants including residual toner particles for example.

2. Description of the Background Art

A background electrophotographic image forming apparatus, such as a copying machine, a printer, or a facsimile machine, generally forms an electrostatic latent image on a photoconductor according to image data. The electrostatic latent image is visualized with toner to form a toner image on the photoconductor. The toner image is transferred onto a sheet and the sheet having the toner image is conveyed to a fixing unit in which heat and pressure are applied to the sheet to fix the toner image on the sheet.

The fixing unit includes a fixing roller for applying heat to the sheet having the toner image, a pressure roller for applying pressure to the sheet having the toner image, and a cleaning member for removing toner particles adhered to a surface of the fixing roller. The fixing roller and the pressure roller oppose to each other to form a nip between the fixing roller and the pressure roller, through which the sheet having the toner image is conveyed for a fixing operation.

During the fixing operation, toner particles of the toner image may be adhered to the surface of the fixing roller, and then may fall onto a surface of the pressure roller. The fallen toner particles may be adhered to a back side of a following sheet which is conveyed to the nip formed between the fixing roller and the pressure roller. To avoid this, the cleaning member contacts or slides on the surface of the fixing roller to remove the toner particles adhered to the surface of the fixing roller.

The background cleaning member is formed in a roller, blade, or web shape. The roller-shaped cleaning member rotates in accordance with rotation of the fixing roller during the fixing operation. Therefore, the roller-shaped cleaning member and the fixing roller may not easily wear, resulting in a long life of the roller-shaped cleaning member and the fixing roller, although the roller-shaped cleaning member may not provide increased cleaning performance.

The blade-shaped cleaning member slides on the surface of the fixing roller. Therefore, the blade-shaped cleaning member and the fixing roller may easily wear, resulting in a short life of the blade-shaped cleaning member and the fixing roller, although the blade-shaped cleaning member may provide increased cleaning performance.

The web-shaped cleaning member contacts the surface of the fixing roller, but may provide increased cleaning performance and a long life of the web-shaped cleaning member and the fixing roller. However, the web-shaped cleaning member may have a complex structure, resulting in a large size fixing unit.

SUMMARY

This specification describes at least one embodiment of a novel image forming apparatus. In an example embodiment of the present invention, the novel image forming apparatus includes an image forming mechanism configured to form a toner image on a recording medium according to image data and a fixing mechanism configured to fix the toner image on the recording medium. The fixing mechanism includes a fixing member configured to apply heat to the toner image on the recording medium and a cleaning mechanism configured to clean a surface of the fixing member. The cleaning mechanism includes a cleaning member and a controller.

The cleaning member is configured to remove contaminants from the surface of the fixing member. The controller is configured to control the cleaning member to cause friction with the fixing member for a time period (which may be determinable and/or predetermined) when a job starts to remove the contaminants from the surface of the fixing member. The controller is also configured to control the cleaning member so as not to cause friction with the fixing member after the time period elapses.

This specification further describes at least one embodiment of a novel image forming method. In an example embodiment of the present invention, the novel image forming method includes forming a toner image on a recording medium according to image data, rotating a fixing member, controlling a cleaning member to cause friction with the fixing member for a time period (which may be determinable and/or predetermined) when a job starts to remove contaminants from a surface of the fixing member, controlling the cleaning member so as not to cause friction with the fixing member after the time period elapses, and fixing the toner image on the recording medium.

BRIEF DESCRIPTION OF THE DRAWINGS

A more complete appreciation of the invention and the many attendant advantages thereof will be readily obtained as the same becomes better understood by reference to the following detailed description of example embodiments when considered in connection with the accompanying drawings, wherein.

DETAILED DESCRIPTION OF EXAMPLE EMBODIMENTS

Figure 1:
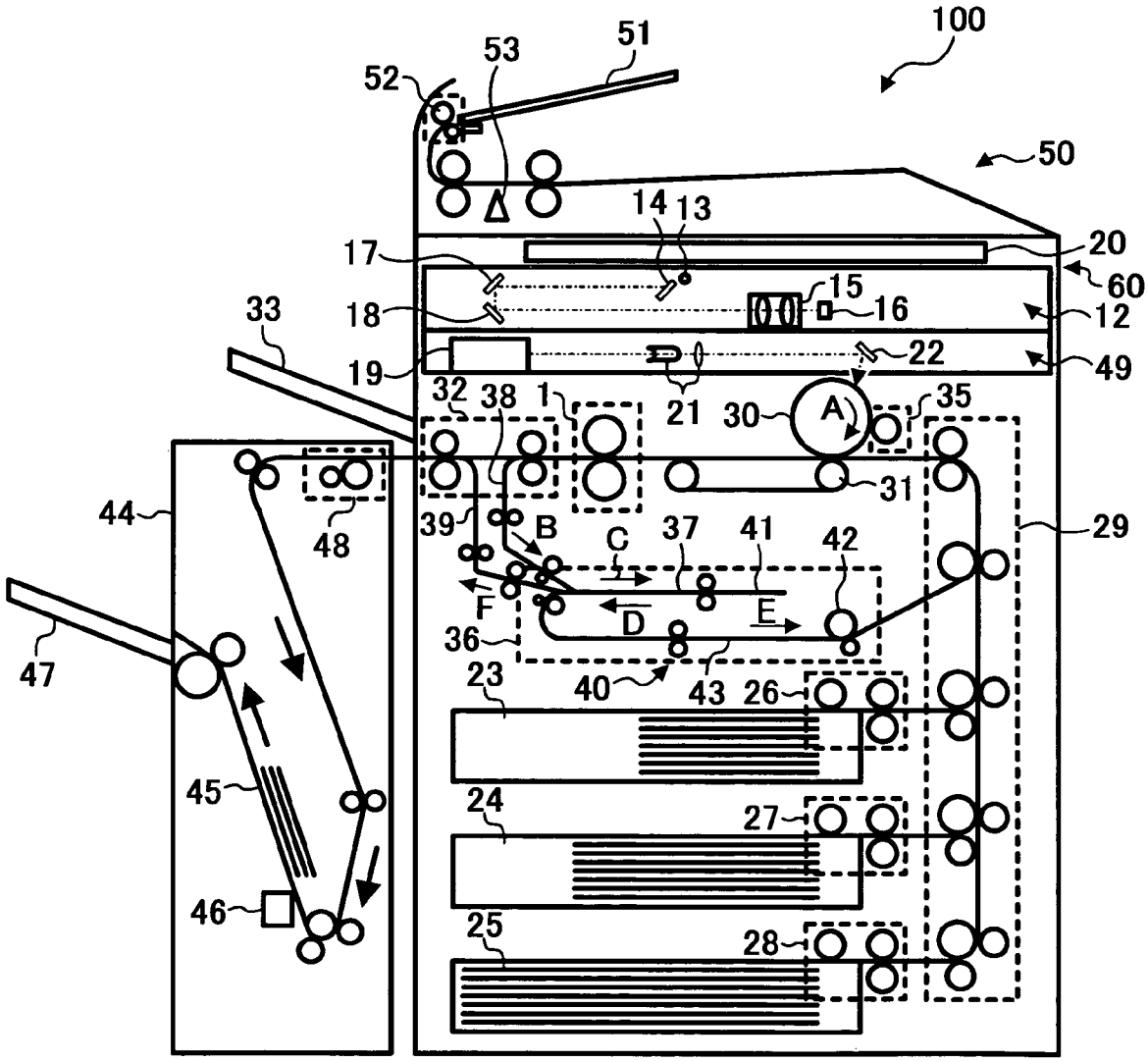
FIG. 1 is a schematic view of an image forming apparatus according to an example embodiment of the present invention.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, an image forming apparatus 100 according to an example embodiment of the present invention is explained.

As illustrated in FIG. 1, the image forming apparatus 100 includes an auto document feeder 50, a reader 60, a writer 49, a first paper tray 23, a second paper tray 24, a third paper tray 25, a first sheet feeder 26, a second sheet feeder 27, a third sheet feeder 28, a sheet conveyance unit 29, a photoconductor 30, a development unit 35, a conveyance belt 31, a fixing unit 1, an output unit 32, an output tray 33, an entrance conveyance path 38, a duplex unit 36, a reverse output conveyance path 39, and/or a finisher 44.

The image forming apparatus 100 functions as a copying machine, a printer, a facsimile machine, or the like which forms an image in an electrophotographic method.

The auto document feeder 50 includes an original tray 51, a feeding roller 52, and/or a reading sensor 53. An original (not shown) to be scanned is placed on the original tray 51. The feeding roller 52 feeds the original toward the reading sensor 53. The reading sensor 53 scans an image on a front side of the original while the original passes on the reading sensor 53 at a constant speed.

The reader 60 includes an exposure glass 20 and/or an optical scanning system 12. The optical scanning system 12 includes a lamp 13, a first mirror 14, a second mirror 17, a third mirror 18, a lens 15, and/or a CCD (charge-coupled device) image sensor 16. An original to be scanned is placed on the exposure glass 20. The lamp 13 emits light onto the original. The first mirror 14 deflects the light reflected by the original toward the second mirror 17. The second mirror 17 deflects the light deflected by the first mirror 14 toward the third mirror 18. The third mirror 18 deflects the light deflected by the second mirror 17 toward the lens 15. The lens 15 irradiates the light deflected by the third mirror 18 into the CCD image sensor 16. The CCD image sensor 16 converts the light into an electric signal.

The writer 49 includes a laser output unit 19, imaging lenses 21, and/or a mirror 22. Various image processing including correction and compression is performed on image data created by scanning an image on the original. The processed image data is stored into a memory (not shown). The laser output unit 19 outputs a laser beam toward the mirror 22 via the imaging lenses 21 according to the stored image data. The imaging lenses 21 correct the speed of the laser beam. The mirror 22 deflects the laser beam toward the photoconductor 30, which rotates in a rotating direction A, to form an electrostatic latent image on the photoconductor 30.

The first paper tray 23, the second paper tray 24, and/or the third paper tray 25 load sheets. The first sheet feeder 26, the second sheet feeder 27, or the third sheet feeder 28 feeds a sheet from the first paper tray 23, the second paper tray 24, or the third paper tray 25 toward the sheet conveyance unit 29. The sheet conveyance unit 29 further feeds the sheet toward the photoconductor 30.

The development unit 35 visualizes the electrostatic latent image formed on the photoconductor 30 with toner to form a toner image. The toner image is transferred onto the sheet while the conveyance belt 31 conveys the sheet at a speed similar to a rotating speed of the photoconductor 30 toward the fixing unit 1. The fixing unit 1 fixes the toner image on the sheet and feeds the sheet toward the output unit 32. The output unit 32 outputs the sheet onto the output tray 33.

The auto document feeder 50, the reader 60, the writer 49, the photoconductor 30, the development unit 35, and/or the conveyance belt 31 form an image forming mechanism for forming a toner image on a sheet according to image data.

To form a toner image on another side (e.g., a back side) of the sheet, a path switching nail (not shown) is switched to send the sheet toward the duplex unit 36 in a direction B via the entrance conveyance path 38 instead of sending the sheet toward the output tray 33. The duplex unit 36 includes a reverse unit 37, a switchback conveyance path 41, an intermediate conveyance path 43, intermediate feeding rollers 40, and/or an exit feeding roller 42.

In the duplex unit 36, the sheet is conveyed in a direction C to the reverse unit 37, and then stops on the switchback conveyance path 41. A switchback feeder (not shown) feeds the sheet in a direction D. A reverse switching nail (not shown) guides the sheet downward to the intermediate conveyance path 43. The intermediate feeding rollers 40 and the exit feeding roller 42 driven by a driver (not shown), for example, a motor, feed the sheet in a direction E toward the sheet conveyance unit 29. A toner image formed on the photoconductor 30 is transferred onto the back side of the sheet, and then the sheet is output onto the output tray 33.

To output the sheet with the toner image facing down, the reverse switching nail is switched to guide the sheet reversed in the reverse unit 37 in a direction F toward the reverse output conveyance path 39 instead of the intermediate conveyance path 43. The sheet is output onto the output tray 33 with the toner image facing down via the output unit 32.

The finisher 44 includes a punch unit 48, a stacking tray 45, a stapler 46, and/or a finisher output tray 47. The sheet may be sent into the finisher 44 by using an output switching nail (not shown). Namely, the sheet may be output either onto the output tray 33 or onto the finisher output tray 47 by switching the output switching nail. The punch unit 48 punches the sheet. The sheets to be stapled are stacked on the stacking tray 45. When all the sheets to be stapled are stacked on the stacking tray 45, the stapler 46 staples the sheets. The stapled sheets are output onto the finisher output tray 47.

Figure 2:
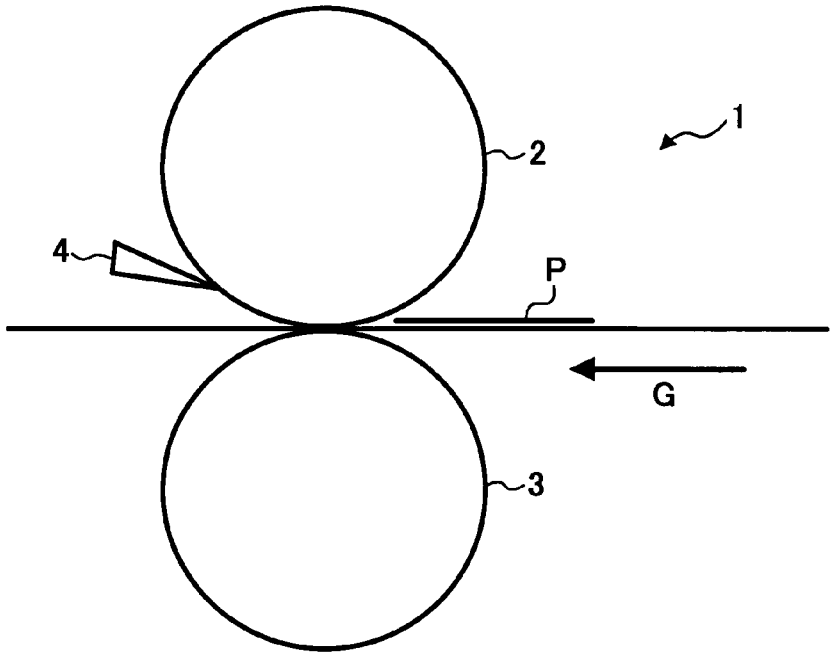
FIG. 2 is a schematic view of a fixing unit of the image forming apparatus shown in FIG. 1.

As illustrated in FIG. 2, the fixing unit 1 includes a fixing roller 2, a pressure roller 3, and/or a separator 4. The fixing roller 2 and the pressure roller 3 oppose to each other and respectively apply heat and pressure to a sheet P conveyed through a nip formed between the fixing roller 2 and the pressure roller 3. The separator 4 separates the sheet P conveyed in a direction G (e.g., a sheet conveyance direction) from the fixing roller 2.

The fixing roller 2 includes a silicone rubber layer (not shown) having a thickness of about 4 mm on a surface of an aluminum core (not shown) having a diameter of about $\phi 50$.

A PFA (perfluoroalkoxy) tube (not shown) covers an uppermost surface of the fixing roller 2.

The pressure roller 3 includes a silicone rubber layer (not shown) having a thickness of about 2 mm on a surface of an aluminum core (not shown) having a diameter of about ϕ50. A PFA tube (not shown) covers an uppermost surface of the pressure roller 3. A halogen heater (not shown) is disposed inside each of the fixing roller 2 and the pressure roller 3. A temperature controller (not shown) controls the halogen heater.

A fixing motor (not shown) drives and rotates the fixing roller 2 for a fixing operation. The fixing roller 2 and the pressure roller 3 stop rotating during standby and start rotating when a job starts. The fixing roller 2 and the pressure roller 3 respectively apply heat and pressure to the sheet P which is conveyed through the nip formed between the fixing roller 2 and the pressure roller 3 to fix the toner image on the sheet P.

The separator 4 is disposed downstream of the fixing roller 2 in the sheet conveyance direction and near the nip formed between the fixing roller 2 and the pressure roller 3. However, the separator 4 may be provided for each of the fixing roller 2 and the pressure roller 3. Otherwise, the separator 4 may be provided for the pressure roller 3 and not for the fixing roller 2.

A fixing member and a pressing member formed in a belt-like shape may be used instead of the fixing roller 2 and the pressure roller 3. Specifically, the fixing unit 1 may include the fixing roller 2 and the belt-like shaped pressing member, the belt-like shaped fixing member and the pressure roller 3, or the belt-like shaped fixing member and the belt-like shaped pressing member.

Figure 3:
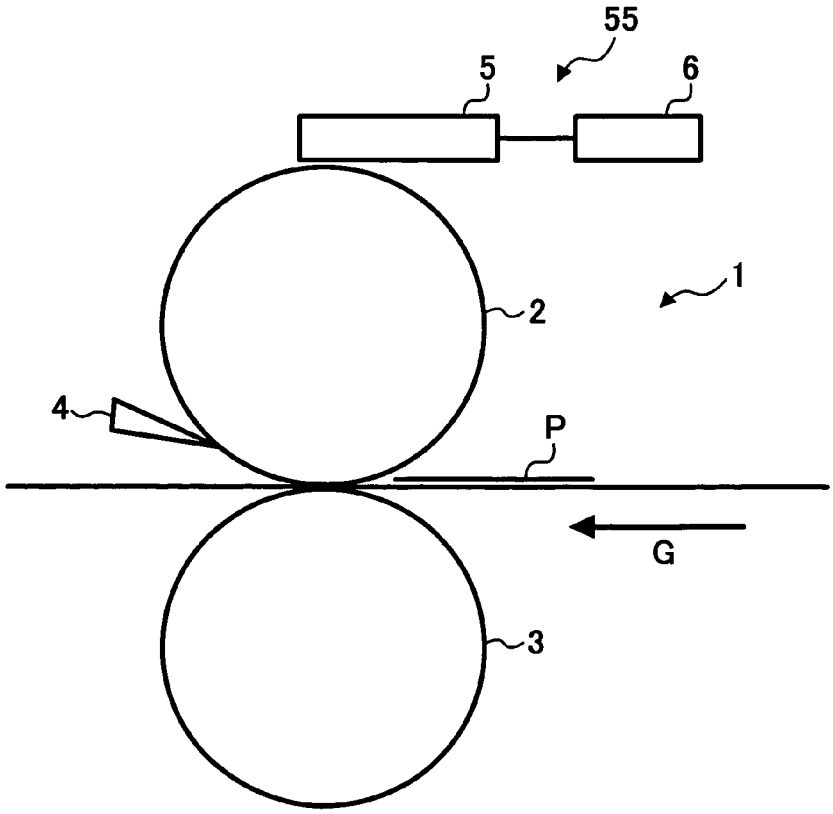
FIG. 3 is a schematic view of a cleaning unit of the fixing unit shown in FIG. 2.

As illustrated in FIG. 3, the fixing unit 1 further includes a cleaning unit 55 including a cleaning member 5 and/or a controller 6. The cleaning member 5 and the controller 6 are disposed near an upper portion of the fixing roller 2. The cleaning member 5 removes contaminants including residual toner particles from a surface of the fixing roller 2. The controller 6 controls the cleaning member 5.

Figure 4:
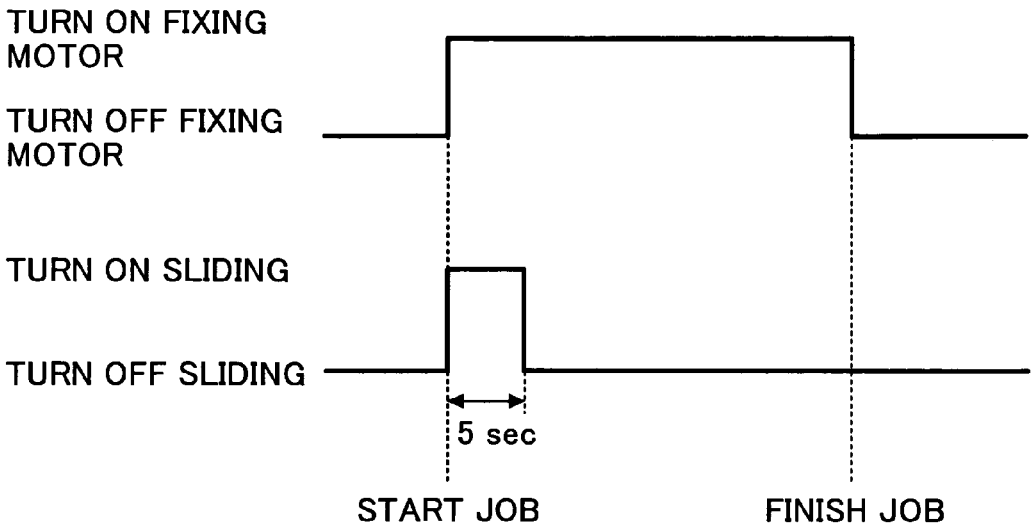
FIG. 4 is a timing chart illustrating operations of the cleaning unit shown in FIG. 3.

As illustrated in FIG. 4, when a job starts, the fixing motor is turned on. Simultaneously, the cleaning member 5 starts sliding on the surface of the fixing roller 2. When about 5 seconds elapse after the fixing motor starts rotating, the cleaning member 5 stops sliding on the surface of the fixing roller 2. The fixing motor continues rotating until the job is finished.

The cleaning member 5 slides on the surface of the fixing roller 2 when the job starts, and does not slide while the job is performed. Thus, when the job starts, toner particles, which may fall off the separator 4 or the like, may be removed, preventing the toner particles from adhering to the back side of the sheet P which faces the pressure roller 3. The cleaning member 5 does not slide on the surface of the fixing roller 2 while the job is performed. Thus, wear of the fixing roller 2 and the cleaning member 5 may be reduced, resulting in a longer life of the fixing roller 2 and the cleaning member 5.

Figure 5:
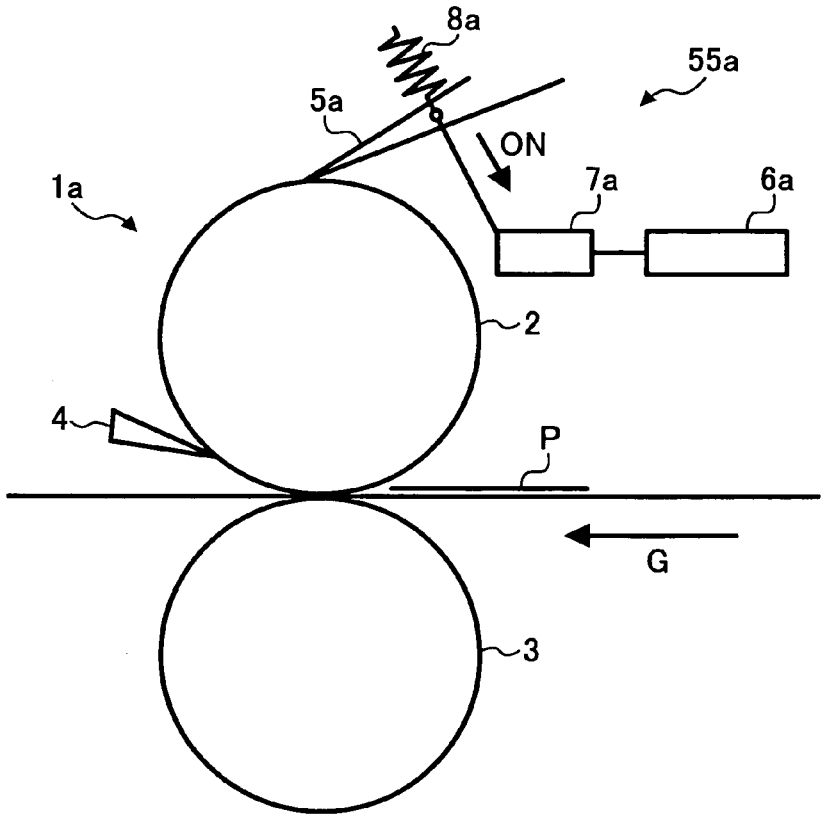
FIG. 5 is a schematic view of a cleaning unit of the fixing unit shown in FIG. 2 according to another example embodiment of the present invention.

FIG. 5 illustrates a fixing unit 1*a* according to another example embodiment of the present invention. As illustrated in FIG. 5, the fixing unit 1*a* includes the fixing roller 2, the pressure roller 3, the separator 4, and/or a cleaning unit 55*a* including a cleaning blade 5*a*, a solenoid 7*a*, a controller 6*a*, and/or a spring 8*a*.

The fixing roller 2 and the pressure roller 3 oppose to each other and respectively apply heat and pressure to a sheet P conveyed through the nip formed between the fixing roller 2 and the pressure roller 3. The separator 4 is disposed downstream of the fixing roller 2 in the sheet conveyance direction and near the nip formed between the fixing roller 2 and the pressure roller 3, and separates the sheet P conveyed in the direction G from the fixing roller 2.

The cleaning blade 5*a*, the solenoid 7*a*, the spring 8*a*, and the controller 6*a* are disposed near the upper portion of the fixing roller 2. The cleaning blade 5*a* contacts and separates from the surface of the fixing roller 2 to remove contaminants including residual toner particles from the surface of the fixing roller 2. The solenoid 7*a* causes the cleaning blade 5*a* to contact the surface of the fixing roller 2. The controller 6*a* controls the solenoid 7*a*. The spring 8*a* causes the cleaning blade 5*a* to separate from the surface of the fixing roller 2. When the solenoid 7*a* is turned on, a head of the cleaning blade 5*a* contacts and slides on the surface of the fixing roller 2 to remove toner particles adhered to the surface of the fixing roller 2.

Figure 6:
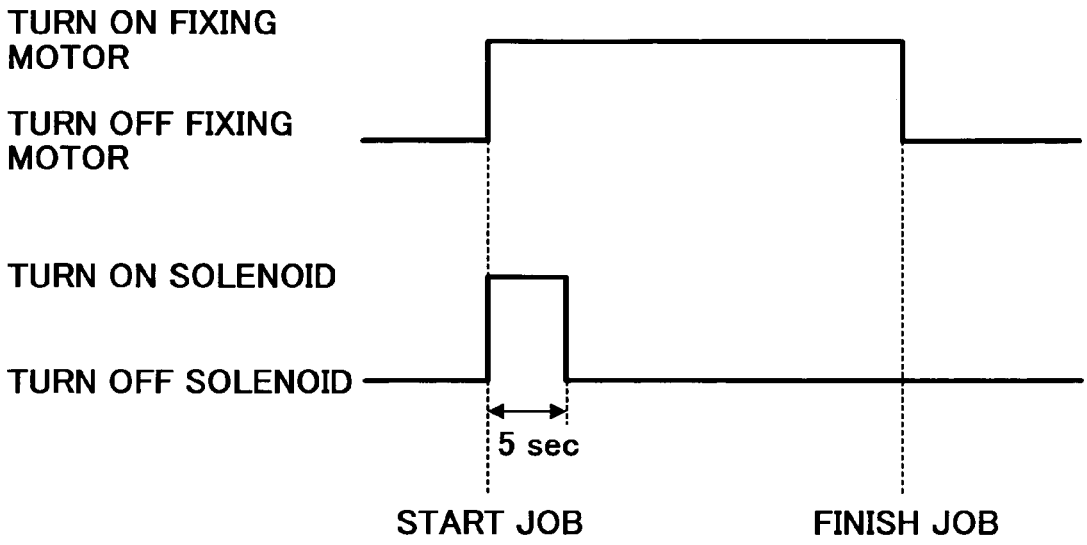
FIG. 6 is a timing chart illustrating operations of the cleaning unit shown in FIG. 5.

As illustrated in FIG. 6, when a job starts, the fixing motor is turned on. Simultaneously, the solenoid 7*a* is turned on to cause the cleaning blade 5*a* to contact and slide on the surface of the fixing roller 2. The cleaning blade 5*a* cleans the surface of the fixing roller 2 for about 5 seconds. When about 5 seconds elapse, the cleaning blade 5*a* separates from the surface of the fixing roller 2 and does not clean the surface of the fixing roller 2 until the job is finished.

Figure 7:
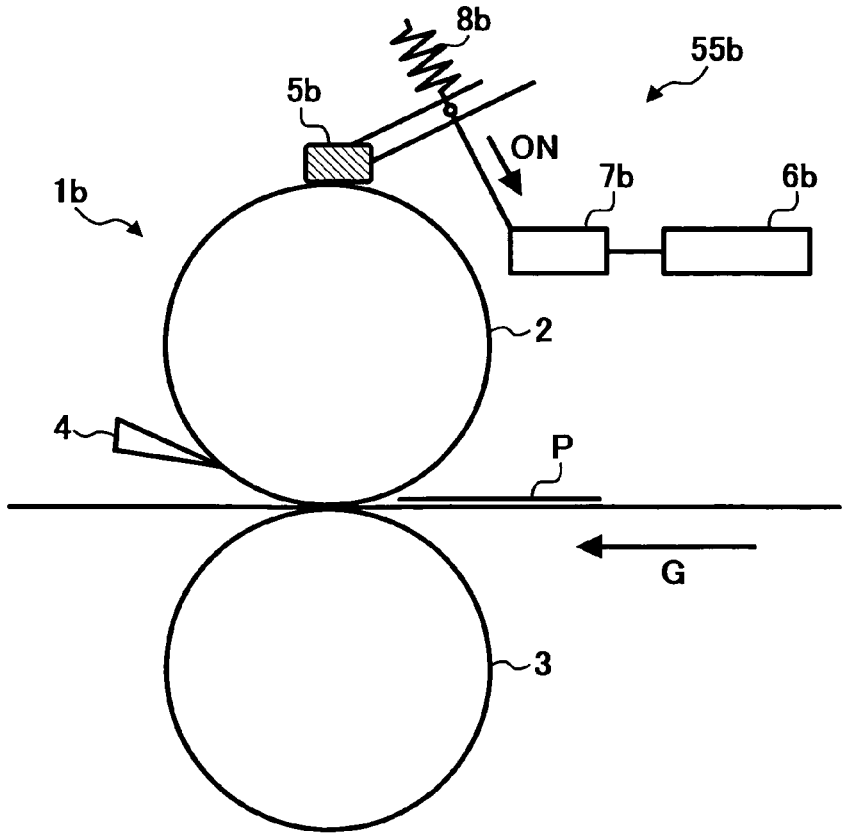
FIG. 7 is a schematic view of a cleaning unit of the fixing unit shown in FIG. 2 according to yet another example embodiment of the present invention.

FIG. 7 illustrates a fixing unit 1*b* according to yet another example embodiment of the present invention. As illustrated in FIG. 7, the fixing unit 1*b* includes the fixing roller 2, the pressure roller 3, the separator 4, and/or a cleaning unit 55*b* including a felt pad 5*b*, a solenoid 7*b*, a controller 6*b*, and/or a spring 8*b*.

The fixing roller 2 and the pressure roller 3 oppose to each other and respectively apply heat and pressure to a sheet P conveyed through the nip formed between the fixing roller 2 and the pressure roller 3. The separator 4 is disposed downstream of the fixing roller 2 in the sheet conveyance direction and near the nip formed between the fixing roller 2 and the pressure roller 3, and separates the sheet P conveyed in the direction G from the fixing roller 2.

The felt pad 5*b*, the solenoid 7*b*, the spring 8*b*, and the controller 6*b* are disposed near the upper portion of the fixing roller 2. The felt pad 5*b* contacts and separates from the surface of the fixing roller 2 to remove contaminants including residual toner particles from the surface of the fixing roller 2. The solenoid 7*b* causes the felt pad 5*b* to contact the surface of the fixing roller 2. The controller 6*b* controls the solenoid 7*b*. The spring 8*b* causes the felt pad 5*b* to separate from the surface of the fixing roller 2. When the solenoid 7*b* is turned on, a head of the felt pad 5*b* contacts and slides on the surface of the fixing roller 2 to remove toner particles adhered to the surface of the fixing roller 2.

Figure 8:
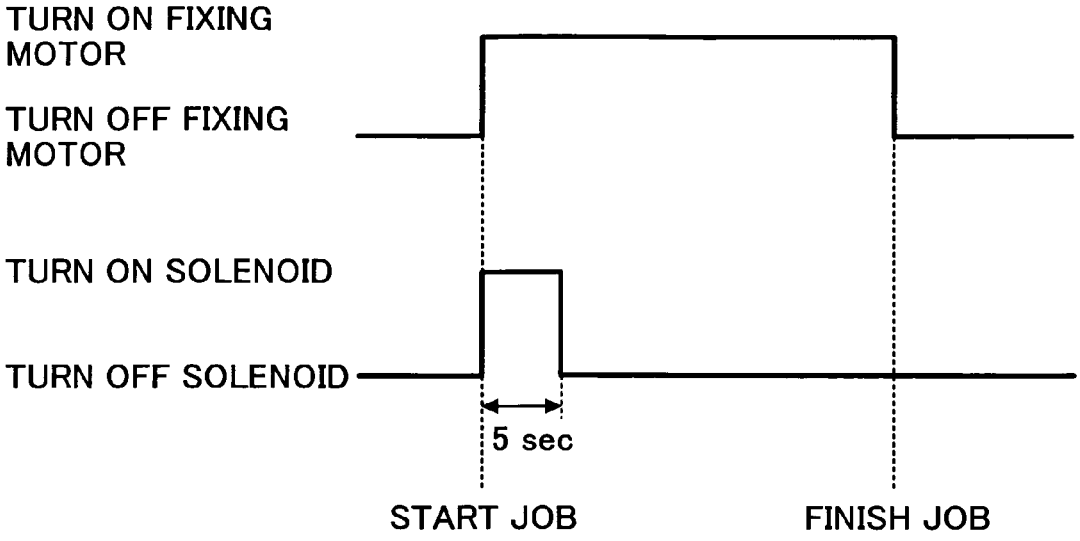
FIG. 8 is a timing chart illustrating operations of the cleaning unit shown in FIG. 7.

As illustrated in FIG. 8, when a job starts, the fixing motor is turned on. Simultaneously, the solenoid 7*b* is turned on to cause the felt pad 5*b* to contact and slide on the surface of the fixing roller 2. The felt pad 5*b* cleans the surface of the fixing roller 2 for about 5 seconds. When about 5 seconds elapse, the felt pad 5*b* separates from the surface of the fixing roller 2 and does not clean the surface of the fixing roller 2 until the job is finished.

The felt pad 5*b* contacting the surface of the fixing roller 2 may remove toner particles adhered to the surface of the fixing roller 2. Fibers of the felt pad 5*b* grab the toner particles. Thus, the toner particles may not remain on the surface of the fixing roller 2 when the felt pad 5*b* separates from the surface of the fixing roller 2.

Figure 9:
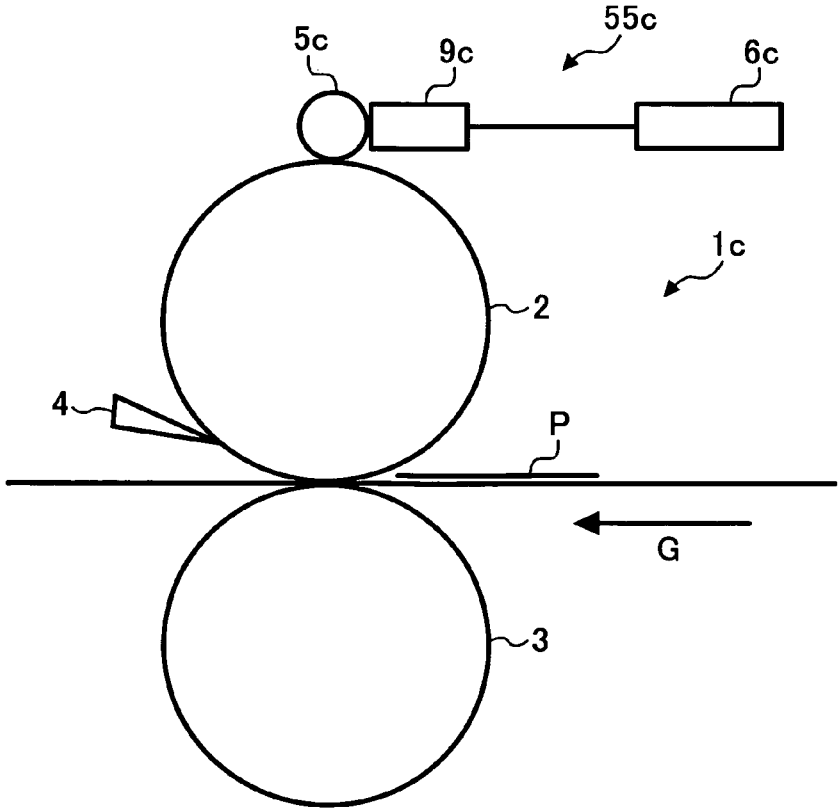
FIG. 9 is a schematic view of a cleaning unit of the fixing unit shown in FIG. 2 according to yet another example embodiment of the present invention.

FIG. 9 illustrates a fixing unit 1*c* according to yet another example embodiment of the present invention. As illustrated in FIG. 9, the fixing unit 1*c* includes the fixing roller 2, the pressure roller 3, the separator 4, and/or a cleaning unit 55*c* including a cleaning roller 5*c*, a controller 6*c*, and/or a brake 9*c*.

The fixing roller 2 and the pressure roller 3 oppose to each other and respectively apply heat and pressure to a sheet P conveyed through the nip formed between the fixing roller 2 and the pressure roller 3. The separator 4 is disposed downstream of the fixing roller 2 in the sheet conveyance direction and near the nip formed between the fixing roller 2 and the pressure roller 3, and separates the sheet P conveyed in the direction G from the fixing roller 2.

The cleaning roller 5*c*, the brake 9*c*, and the controller 6*c* are disposed near the upper portion of the fixing roller 2. The cleaning roller 5*c* rotates to remove contaminants including residual toner particles from the surface of the fixing roller 2. The cleaning roller 5*c* includes a sponge roller (not shown) having a diameter of about ϕ14 and a surface layer (not shown) including a PFA tube having a thickness of about 20 μm and covering the sponge roller. Positions of shafts of the fixing roller 2 and the cleaning roller 5*c* are fixed and surfaces of the fixing roller 2 and the cleaning roller 5*c* are engaged in each other by about 1 mm.

The brake 9*c* is disposed in an end portion of the shaft of the cleaning roller 5*c* and stops the rotating cleaning roller 5*c*. When the brake 9*c* is turned on, the cleaning roller 5*c*, which rotates in accordance with rotation of the fixing roller 2, stops rotating. The cleaning roller 5*c* slides on the surface of the fixing roller 2 to remove toner particles adhered to the surface of the fixing roller 2. The controller 6*c* controls the brake 9*c*.

Figure 10:
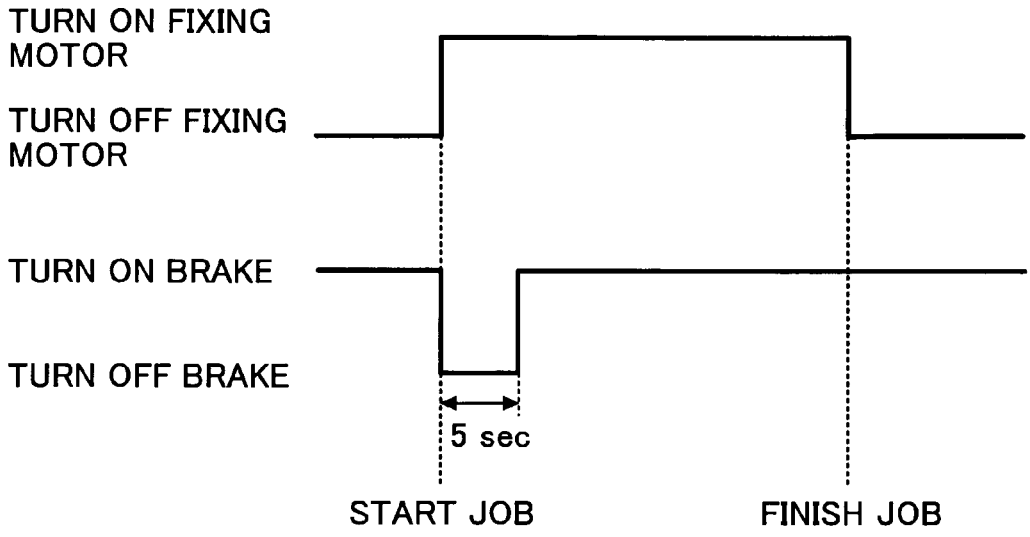
FIG. 10 is a timing chart illustrating operations of the cleaning unit shown in FIG. 9.

As illustrated in FIG. 10, when a job starts, the fixing motor is turned on. Simultaneously, the cleaning roller 5*c* starts sliding on the surface of the fixing roller 2. Specifically, the brake 9*c* is turned on for about 5 seconds when the job starts. Thus, the cleaning roller 5*c* slides on the surface of the fixing roller 2 to clean the surface of the fixing roller 2. When about 5 seconds elapse, the cleaning roller 5*c* rotates in accordance with rotation of the fixing roller 2 and does not clean the surface of the fixing roller 2 until the job is finished.

When the job starts, the cleaning roller 5*c* stops rotating and slides on the surface of the fixing roller 2 to remove toner particles adhered to the surface of the fixing roller 2. The cleaning roller 5*c* rotates in accordance with rotation of the fixing roller 2 and does not slide on the surface of the fixing roller 2 while the job is performed. Thus, wear of the fixing roller 2 and the cleaning roller 5*c* may be reduced, resulting in a longer life of the fixing roller 2 and the cleaning roller 5*c*. The cleaning roller 5*c* may not move to contact and separate from the surface of the fixing roller 2, resulting in a simple structure of the cleaning unit 55*c* and preventing toner particles from falling onto the surface of the fixing roller 2.

Figure 11:
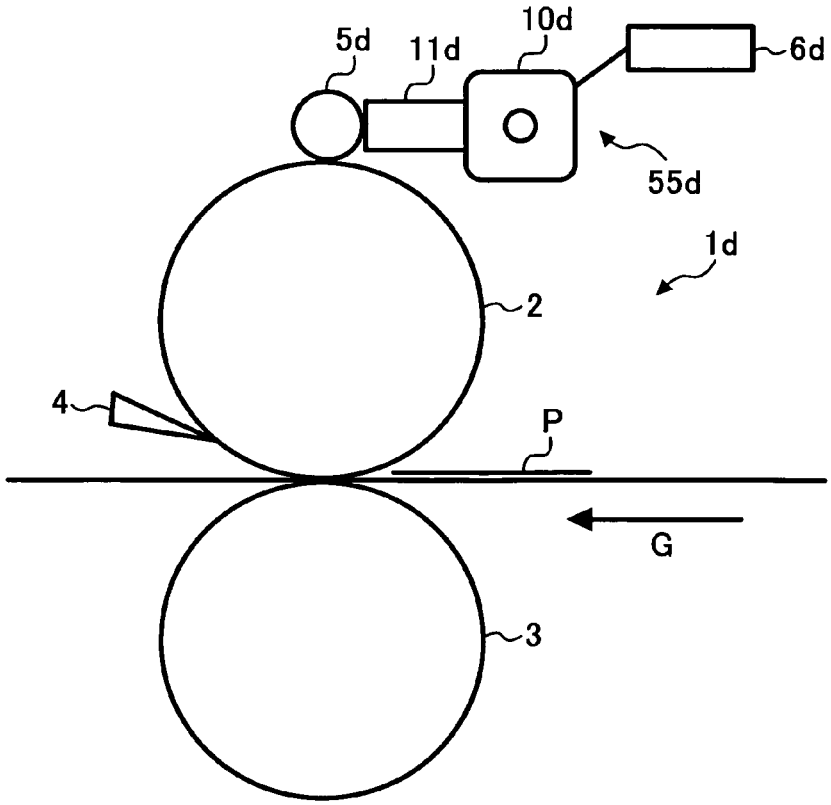
FIG. 11 is a schematic view of a cleaning unit of the fixing unit shown in FIG. 2 according to yet another example embodiment of the present invention.

FIG. 11 illustrates a fixing unit 1*d* according to yet another example embodiment of the present invention. As illustrated in FIG. 11, the fixing unit 1*d* includes the fixing roller 2, the pressure roller 3, the separator 4, and/or a cleaning unit 55*d* including a cleaning roller 5*d*, a controller 6*d*, a cleaning roller driving motor 10*d*, and/or a clutch 11*d*.

The fixing roller 2 and the pressure roller 3 oppose to each other and respectively apply heat and pressure to a sheet P conveyed through the nip formed between the fixing roller 2 and the pressure roller 3. The separator 4 is disposed downstream of the fixing roller 2 in the sheet conveyance direction and near the nip formed between the fixing roller 2 and the pressure roller 3, and separates the sheet P conveyed in the direction G from the fixing roller 2.

The cleaning roller 5*d*, the cleaning roller driving motor 10*d*, the clutch 11*d*, and the controller 6*d* are disposed near the upper portion of the fixing roller 2. The cleaning roller 5*d* rotates to remove contaminants including residual toner particles from the surface of the fixing roller 2. The cleaning roller 5*d* includes a sponge roller (not shown) having a diameter of about ϕ14 and a surface layer (not shown) including a PFA tube having a thickness of about 20 μm and covering the sponge roller. Positions of shafts of the fixing roller 2 and the cleaning roller 5*d* are fixed and surfaces of the fixing roller 2 and the cleaning roller 5*d* are engaged in each other by about 1 mm.

The cleaning roller driving motor 10*d* is disposed in an end portion of the shaft of the cleaning roller 5*d* and drives the cleaning roller 5*d* at a constant number of rotations. When the cleaning roller driving motor 10*d* is turned on, the cleaning roller 5*d* rotates at a linear velocity slower than a linear velocity of the fixing roller 2. The cleaning roller 5*d* slides on the surface of the fixing roller 2 to remove toner particles adhered to the surface of the fixing roller 2. For example, when the fixing roller 2 rotates at a linear velocity of about 200 mm/sec, the cleaning roller 5*d* rotates at a linear velocity of about 165 mm/sec. The controller 6*d* controls the cleaning roller driving motor 10*d*. The clutch 11*d* connects and disconnects the cleaning roller driving motor 10*d* to and from the cleaning roller 5*d*.

Figure 12:
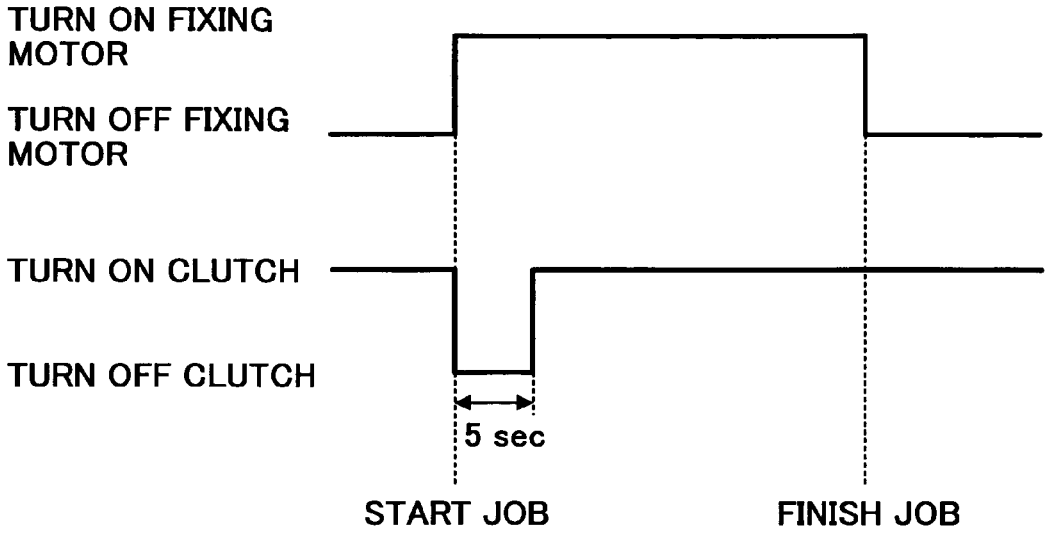
FIG. 12 is a timing chart illustrating operations of the cleaning unit shown in FIG. 11.

As illustrated in FIG. 12, when a job starts, the fixing motor is turned on. Simultaneously, the cleaning roller 5*d* starts sliding on the surface of the fixing roller 2. Specifically, the cleaning roller driving motor 10*d* is turned on for about 5 seconds when the job starts. Thus, the cleaning roller 5*d* slides on the surface of the fixing roller 2 to clean the surface of the fixing roller 2. When about 5 seconds elapse, the cleaning roller 5*d* rotates in accordance with rotation of the fixing roller 2 and does not clean the surface of the fixing roller 2 until the job is finished.

When the job starts, the cleaning roller 5*d* is driven to rotate at the linear velocity different from the linear velocity of the fixing roller 2 so as to slide on the surface of the fixing roller 2 to remove toner particles adhered to the surface of the fixing roller 2. The cleaning roller 5*d* rotates in accordance with rotation of the fixing roller 2 and does not slide on the surface of the fixing roller 2 while the job is performed. Thus, wear of the fixing roller 2 and the cleaning roller 5*d* may be reduced, resulting in a longer life of the fixing roller 2 and the cleaning roller 5*d*.

The cleaning roller 5*d* may not move to contact and separate from the surface of the fixing roller 2, resulting in a simple structure of the cleaning unit 55*d* and preventing toner particles from falling onto the surface of the fixing roller 2. When cleaning the surface of the fixing roller 2, the cleaning roller 5*d* does not stop rotating and rotates at the linear velocity different from the linear velocity of the fixing roller 2. Thus, toner particles may not intensively adhere to a certain part on the surface of the cleaning roller 5*d* in a circumferential direction of the cleaning roller 5*d*, but may uniformly adhere to the surface of the cleaning roller 5*d*, resulting in an even longer life of the cleaning roller 5*d*.

Figure 13:
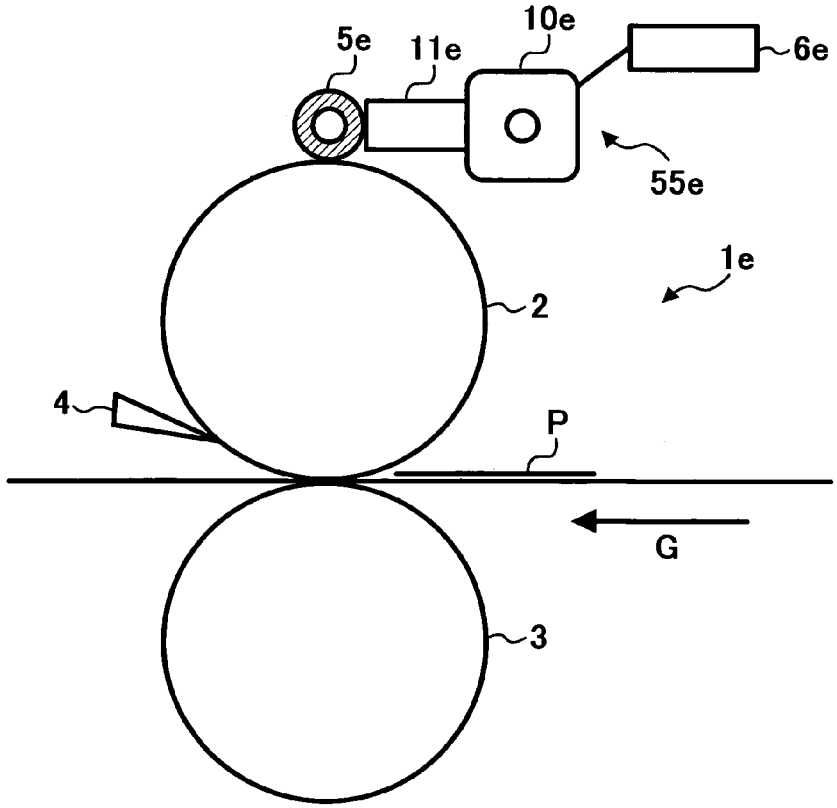
FIG. 13 is a schematic view of a cleaning unit of the fixing unit shown in FIG. 2 according to yet another example embodiment of the present invention.

FIG. 13 illustrates a fixing unit 1*e* according to yet another example embodiment of the present invention. As illustrated in FIG. 13, the fixing unit 1*e* includes the fixing roller 2, the pressure roller 3, the separator 4, and a cleaning unit 55*e* including a cleaning felt roller 5*e*, a controller 6*e*, a cleaning roller driving motor 10*e*, and a clutch 11*e*.

The fixing roller 2 and the pressure roller 3 oppose to each other and respectively apply heat and pressure to a sheet P conveyed through the nip formed between the fixing roller 2 and the pressure roller 3. The separator 4 is disposed downstream of the fixing roller 2 in the sheet conveyance direction and near the nip formed between the fixing roller 2 and the pressure roller 3, and separates the sheet P conveyed in the direction G from the fixing roller 2.

The cleaning felt roller 5*e*, the cleaning roller driving motor 10*e*, the clutch 11*e*, and the controller 6*e* are disposed near the upper portion of the fixing roller 2. The cleaning felt roller 5*e* rotates to remove contaminants including residual toner particles from the surface of the fixing roller 2. The cleaning felt roller 5*e* has a diameter of about ϕ14, for example. A spring (not shown) presses the cleaning felt roller 5*e* toward the fixing roller 2.

The cleaning roller driving motor 10*e* is disposed in an end portion of a shaft of the cleaning felt roller 5*e* and drives the cleaning felt roller 5*e* at a constant number of rotations. When the cleaning roller driving motor 10*e* is turned on, the cleaning felt roller 5*e* rotates at a linear velocity slower than a linear velocity of the fixing roller 2. The cleaning felt roller 5*e* slides on the surface of the fixing roller 2 to remove toner particles adhered to the surface of the fixing roller 2. For example, when the fixing roller 2 rotates at a linear velocity of about 200 mm/sec, the cleaning felt roller 5*e* rotates at a linear velocity of about 165 mm/sec. The controller 6*e* controls the cleaning roller driving motor 10*e*. The clutch 11*e* connects and disconnects the cleaning roller driving motor 10*e* to and from the cleaning felt roller 5*e*.

Figure 14:
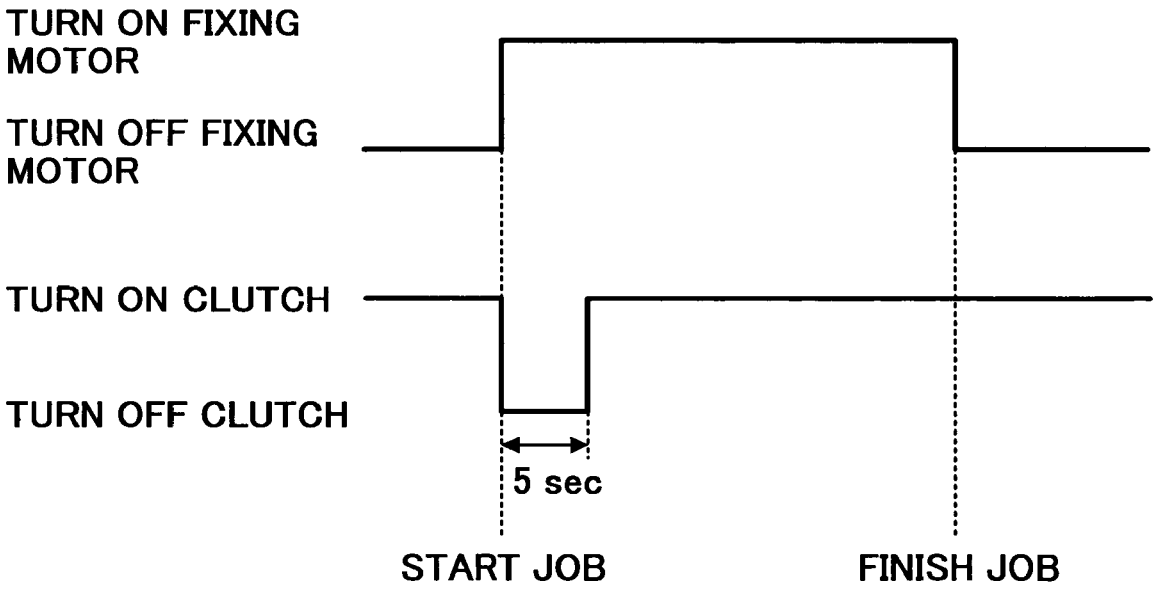
FIG. 14 is a timing chart illustrating operations of the cleaning unit shown in FIG. 13.

As illustrated in FIG. 14, when a job starts, the fixing motor is turned on. Simultaneously, the cleaning felt roller 5*e* starts sliding on the surface of the fixing roller 2. Specifically, the cleaning roller driving motor 10*e* is turned on for about 5 seconds when the job starts. Thus, the cleaning felt roller 5*e* slides on the surface of the fixing roller 2 to clean the surface of the fixing roller 2. When about 5 seconds elapse, the cleaning felt roller 5*e* rotates in accordance with rotation of the fixing roller 2 and does not clean the surface of the fixing roller 2 until the job is finished.

The cleaning felt roller 5*e* sliding on the surface of the fixing roller 2 may remove toner particles adhered to the surface of the fixing roller 2. Fibers of the cleaning felt roller 5*e* grab the toner particles. Thus, the toner particles may not be transferred onto the surface of the fixing roller 2 when the cleaning felt roller 5*e* rotates in accordance with rotation of the fixing roller 2.

The present invention has been described above with reference to specific embodiments. Note that the present invention is not limited to the details of the embodiments described above, but various modifications and improvements are possible without departing from the spirit and scope of the invention. It is therefore to be understood that within the scope of the appended claims, the present invention may be practiced otherwise than as specifically described herein. For example, elements and/or features of different illustrative embodiments may be combined with each other and/or substituted for each other within the scope of the present invention and appended claims.

What is claimed is:

1. An image forming apparatus, comprising:

an image forming mechanism to form a toner image on a recording medium according to image data; and a fixing mechanism to fix the toner image on the recording medium and including, a fixing member to apply heat to the toner image on the recording medium, and a cleaning mechanism to clean a surface of the fixing member and including, a cleaning member to remove contaminants from the surface of the fixing member, and a controller to control the cleaning member at a linear velocity different from a linear velocity of the rotating fixing member for a time period after a job starts and before the job finishes to cause friction with the fixing member and remove the contaminants from the surface of the fixing member, and after the time period elapses, the controller being configured to rotate the cleaning member in accordance with rotation of the fixing member so as not to cause friction between the cleaning member and the fixing member.

2. The image forming apparatus according to claim 1, wherein the controller stops rotating the cleaning member for the time period when the job starts to cause friction between the cleaning member and the fixing member, and wherein the controller rotates the cleaning member in accordance with rotation of the fixing member after the time period elapses, so as not to cause friction between the cleaning member and the fixing member.

3. The image forming apparatus according to claim 1, wherein the cleaning member includes felt.

4. The image forming apparatus according to claim 1, wherein the cleaning member is useable to remove contaminants including residual toner particles.

5. The image forming apparatus according to claim 1, wherein the elapsed time period is for approximately 5 seconds.

6. The image forming apparatus according to claim 1, further comprising a separator disposed downstream of the fixing member in a sheet conveyance direction.

7. An image forming method, comprising:

forming a toner image on a recording medium according to image data;

rotating a fixing member;

controlling a cleaning member at a linear velocity different from a linear velocity of the rotating fixing member for a time period after a job starts and before the job finishes to cause friction with the fixing member and remove contaminants from a surface of the fixing member;

controlling the cleaning member in accordance with rotation of the fixing member after the time period elapses so as not to cause friction between the cleaning member and the fixing member; and fixing the toner image on the recording medium.

8. The image forming method of claim 7, wherein the cleaning member is controlled to cause friction with the fixing member for a time period when a job starts, to remove contaminants including residual toner particles from the surface of the fixing member.

9. The image forming method according to claim 7, wherein the cleaning member is controlled to stop rotating for the time period when the job starts to cause friction between the cleaning member and the fixing member, and wherein the cleaning member is rotated in accordance with rotation of the fixing member after the time period elapses, so as not to cause friction between the cleaning member and the fixing member.

10. The image forming method of claim 7, wherein the elapsed time period is for approximately 5 seconds.

11. The image forming method of claim 7, further comprising a separator disposed downstream of the fixing member in a sheet conveyance direction.

12. A cleaning apparatus to clean a surface of a fixing device to fix toner in an image forming apparatus, comprising:

a cleaning member to remove contaminants from a surface of the fixing device; and a controller to rotate the cleaning member at a linear velocity different from a linear velocity of the rotating fixing device for a time period after a job starts and before the job finishes to cause friction with the fixing device and remove the contaminants from the surface of the fixing device, and after the time period elapses, the controller being configured to rotate the cleaning member in accordance with rotation of the fixing device so as not to cause friction between the cleaning member and the fixing device.

13. The cleaning apparatus according to claim 12, wherein the cleaning member includes felt.

14. The cleaning apparatus according to claim 12, wherein the cleaning member is useable to remove contaminants including residual toner particles.

15. The cleaning apparatus according to claim 12, wherein the elapsed time period is for approximately 5 seconds.

16. The cleaning apparatus according to claim 12, further comprising a separator disposed downstream of the fixing device in a sheet conveyance direction.

* * * * *